United States Patent [19]

Lautenschläger, Jr. et al.

[11] Patent Number: 4,654,930

[45] Date of Patent: Apr. 7, 1987

[54] SELF-CLOSING OVER-CENTER HINGE HAVING A LINK GUIDED IN A SPRING BIASED CAM

[75] Inventors: Karl Lautenschläger, Jr., Reinheim; Gerhard Lautenschläger, Brensbach, both of Fed. Rep. of Germany

[73] Assignee: Karl Lautenschläger GmbH & Co. KG, Reinheim, Fed. Rep. of Germany

[21] Appl. No.: 854,997

[22] Filed: Apr. 22, 1986

[30] Foreign Application Priority Data

Apr. 22, 1985 [DE] Fed. Rep. of Germany ..... 3514480

[51] Int. Cl.[4] ..... E05F 1/08

[52] U.S. Cl. ..... 16/288; 16/72; 16/291; 16/294; 16/296

[58] Field of Search ..... 16/72, 288, 291, 293, 16/294, 296, 302

[56] References Cited

U.S. PATENT DOCUMENTS 4,457,047 7/1984 Lautenschlager ..... 16/302 X

FOREIGN PATENT DOCUMENTS 2408057 8/1975 Fed. Rep. of Germany ..... 16/294

*Primary Examiner*—Fred Silverberg

[57] ABSTRACT

In a hinge for cabinet doors, a four-joint hinge articulation having two links and a single-arm lever pivotally mounted in the cabinet wall-related hinge part with its free end able to swing in a plane lying at right angles to the axis of the articulation and being urged under resilient bias against the cam face of a cam body disposed in the area of the wall-end pivot eye of the inner link, the cam body is journaled on an axis offset from the pivot axis of the pivot eye of the inner link, and additionally guided for displacement at a distance from the two pivot axes between the pivot eyes on opposite sides of the inner link.

6 Claims, 4 Drawing Figures

SELF-CLOSING OVER-CENTER HINGE HAVING A LINK GUIDED IN A SPRING BIASED CAM

BACKGROUND OF THE INVENTION

The invention relates to an over-center self-closing hinge for cabinet doors, having: a four-joint articulation with two links, a single-arm lever journaled at its stationary end in the wall-related part of the hinge and formed by a compression spring whose free end can swing in a plane at right angles to the hinge pivot axis, and a cam body which is disposed in the area of the wall-related journal of the inner link (the one closer to the wall). The cam body is journaled on an axis in the wall-related part of the hinge, and additionally is supported at opposite ends of the inner link in the area between the two journals, and has a cam face engaged by the spring under bias.

IA self-closing over-center hinge of this kind is known (DE-OS No. 24 08 057), in which the lever rotating at right angles to the axis of articulation and resiliently biased against the cam face of the cam body is formed by a leaf spring biased at one end directly against the cam face. This hinge has proven practical and is used in great numbers where the door closing or holding force to be applied by the over-center mechanism is not too high. On account of the special geometry of four-joint hinges, the angular deflection of the inner link from the open position to the closed position, or vice-versa, is decidedly less than the angular deflection of the door hung on a cabinet with the hinge. It follows that the effective angular length of the face of the cam body that is affixed to the wall-end pivot eye of the inner hinge link is relatively short. In order to transmit a high force to the inner hinge link, and thus to the door-related hinge part, and ultimately to the door, with such a short rotation of the cam body, a spring must be used which is under high bias, since the short effective length of the cam does not permit any great spring movement. This bias, however, then acts constantly not just between the lever and the cam body, but also on the pivot of the inner link. Consequently, with a view to the useful life of the hinge, the door-holding force that can be achieved in the known hinges is limited.

Accordingly, the problem to which the invention is addressed is to improve the known hinge such that its over-center mechanism will apply a greater closed-door holding force without reducing its useful life.

SUMMARY OF THE INVENTION

Setting out from a hinge of the kind mentioned above, this problem is solved according to the invention in that the pivot axis of the cam body is an additional axis which is shifted toward the wall-related journal of the inner link, that the support of the cam body on the inner link is a displaceable guide means situated at a distance from its two journals, and that the shift of the cam body axis from the journal axis of the inner link is in such a direction that the cam body axis is always at a greater distance from the point on the cam face on which the closing spring acts than the axis of the journal of the link. In this manner the turning movement of the inner hinge link is transmitted to the cam body such that its cam face will perform, relative to the lever end biased against it, a decidedly greater displacement than would the cam face of the cam body of the known hinge which is fixedly joined to the inner hinge link. Thus the effective length of the cam face becomes correspondingly greater, which in turn permits the achievement of a greater spring movement. Thus it is possible to produce higher closed-door holding forces without stronger springs or the same holding forces with weaker springs, than with the known hinge.

The cam body is preferably in the form of a hollow body which encloses the pivot eye of the inner link over substantially its entire width, with clearance, and has a slot-like opening for the admission of the inner link.

It may be desirable to configure the cam body such that it extends slightly beyond the pivot eye of the inner link on both sides, and that its cavity will be enclosed by side walls laterally covering the ends of the pivot eye, arcuate slots then being provided in these side walls to accommodate the pivot pin on which the pivot eye is journaled in the wall-related hinge part.

To be able to mount the cam body largely enveloping the pivot eye, it is recommendable that it be composed of two cam body halves of mirror-image symmetry which can be placed one against each side of the pivot eye and can then be fastened together after installation on the pivot eye. This can be done in many different ways, e.g., by cementing, pinning or also by snap-fastening the two cam body halves to one another.

To minimize the friction between the single-armed lever and the cam face of the cam body, the cam body is preferably made of a plastic having appropriate lubricating properties and sufficient resistance to wear.

BRIEF DESCRIPTION OF THE DRAWING

The invention is further explained in the description that follows of an embodiment in conjunction with the drawing, wherein.

DETAILED DESCRIPTION OF PREFERRED EMBODIMENTS

Figure 1:
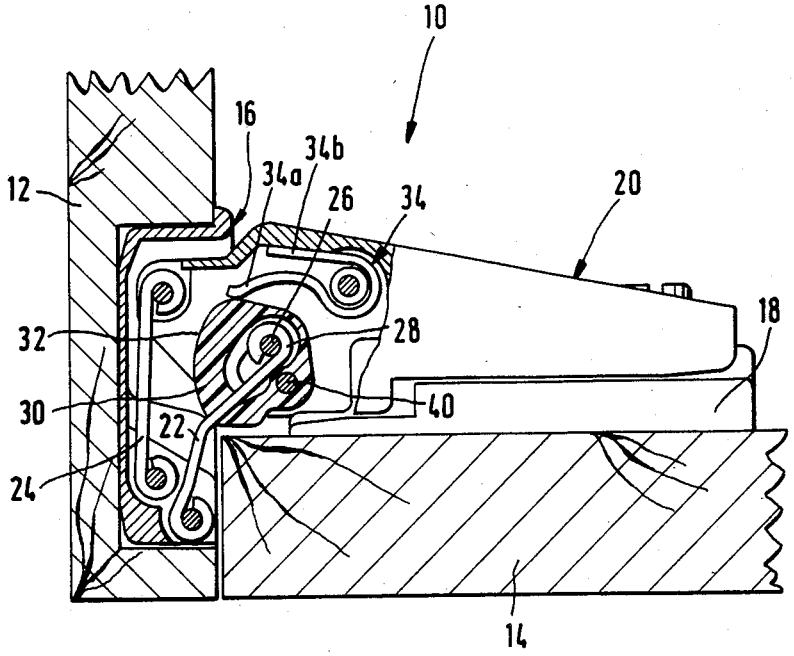
FIG. 1 is a side view, partially in cross section, of an over-center self-closing hinge according to the invention in the closed position.
Figure 2:
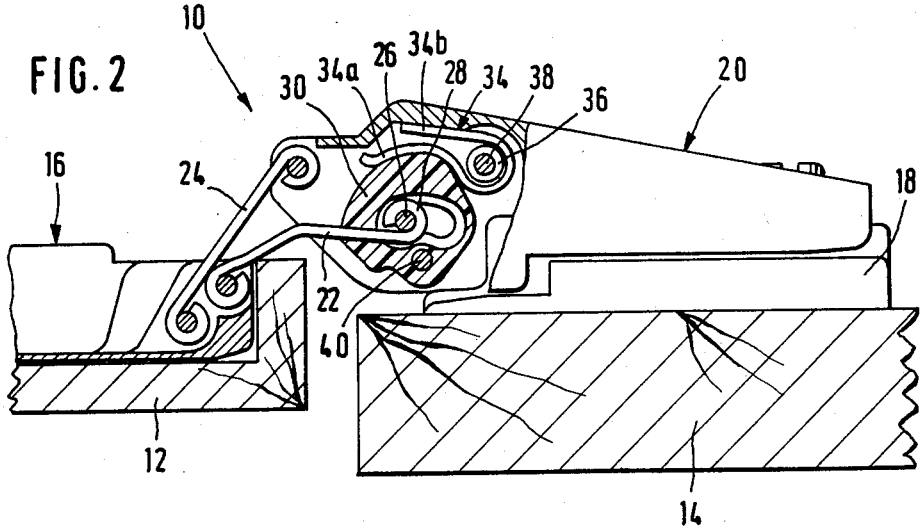
FIG. 2 is a view corresponding to FIG. 1 of the hinge in the open position.

The over-center self-closing hinge shown in FIGS. 1 and 2 and identified as a whole by the number 10 serves to hang a door 12 on the wall 14 of a cabinet not otherwise shown. The hinge consists, in a known manner, of a cup 16 which can be inserted flush into a mortise in the back of the door 12, which is coupled to the elongated supporting arm 20 of channel-like cross section held adjustably on a mounting plate 18 fastened to the wall 14, by means of two links 22 and 24 journaled each at one end in the cup 16 and at the other end on the supporting arm 20. The over-center mechanism has, in the area of the wall-related end of the inner link 22, i.e., the link nearer the cabinet interior when the door is closed, a hollow cam body 30 enveloping a pivot eye 28 journaled on a pivot pin 26 affixed in the supporting arm, and the edge of the cam body opposite the outer link 24 and opposite the back of the channel-like supporting arm 20 forms a cam face 32. This cam face 32 is engaged with bias by the free end of a single-arm lever turning at right angles to the articulation axis of the hinge; in the case represented this lever is formed by one limb 34*a* of a leaf spring 34 bent to a U-shape, whose second limb 34*b* thrusts against the bottom of the back of the supporting arm 20. The leaf spring 34 is held in a position with the free ends of the limbs pointing out of the cabinet interior by means of a pin held in the sides of the supporting arm 20 with the interposition of a roller 36 to match the arcuate transition between the limbs 34*a* and 34*b*. The leaf spring 34 is installed simply by placing it on the pin 38 or the bearing 36 if used, and the arcuate transition between the limbs 34*a* and 34*b* of the leaf spring 34, which reaches around the bearing 36 by an angle of more than 90 degrees, prevents the leaf spring from escaping accidentally from the bearing.

The cam body 36, configured, as previously stated, as a hollow body, is not fixedly joined to the pivot eye 28, but is in turn pivoted on a cross pin 40 passing through it on the side opposite the cam faces. The link 22 passes through a slot 42 in the cam body 30. In the event of a movement of the link 22 resulting from the opening or closing of the door 12, the cam body 30 is pivoted by the link 22, which can turn only on its axis which is situated at a distance below the pivot pin 26 of the pivot eye 28 and is formed by the cross pin 40. The different pivotal movements of the link 22 and cam body 30, however, are possible only because the cam body is a hollow body, i.e., the pivot eye 28 can change its position within the hollow body, in which case the link 22 then shifts relative to the walls of the cam body defining the slot 42.

Figure 3:
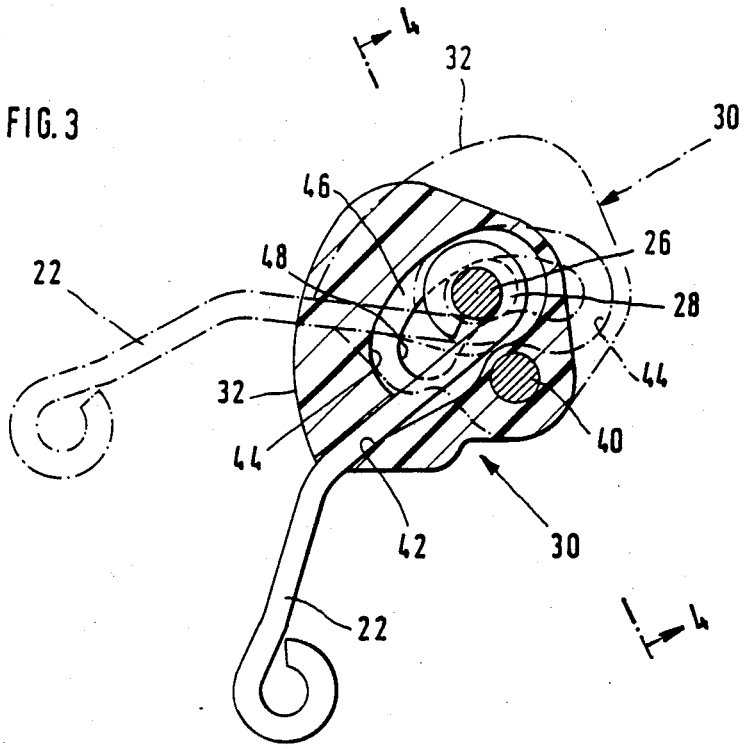
FIG. 3 is an enlarged view of a portion of the inner hinge link with the corresponding cam body, in the closed position corresponding to FIG. 1, the open position being additionally represented in broken lines.
Figure 4:
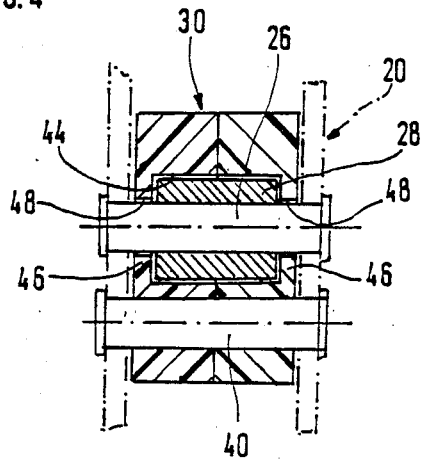
FIG. 4 is a section through the cam body.

In FIG. 3 there is shown the relative position of the cam body 30 and of the inner hinge link 22 in the closed position, and also, in broken lines, in the open position.

The cam body 30, due to its separate articulation on the supporting arm 20, performs a modified angular movement with respect to the link 22, and experiments have shown that, if the position of the pivot axes of the link 22 and of the cam body 30 is appropriately selected, a decided increase of the effective length of the cam face is achievable. The cam face 32, therefore, can act over a decidedly longer range in comparison to the cam face of a fixed cam body, and therefore overall greater movements of the spring limb 34*a* can be achieved, which can thus be installed with less bias.

The cam body 30 itself is best made from a wear-resistant plastic having suitable lubricant properties. In the case represented, the cavity 44 of the cam body which receives the pivot eye 28 is enclosed by side walls 46, in which, however, arcuate slots 48 concentric with the cross pin 40 are provided to accommodate the pivot pin 28. The cam body 30 can be composed of two halves of a mirror-image configuration, which are placed on opposite sides of the pivot eye 28 and can then be fastened together in an appropriate manner.

It can be seen that modifications and further developments of the embodiment described can be made within the scope of the invention. Thus, instead of the U-shaped leaf spring 34, a rigid single-arm lever journaled at one end in the supporting arm and biased at the other end by a separate compression spring can be used, which is urged directly or, to avoid friction, through one or more rollers against the cam face 32. The cam body 30 can also be modified with respect to the configuration described. It can also be made of metal, in which case the greater strength permits the elimination of the side walls 46.

We claim:

1. An over-center self-closing hinge comprising: a wall-related part having means for attachment to a wall of a cabinet, a door-related part for attachment to a door of a cabinet, a first hinge link, and a second hinge link, a first shaft pivotally connecting said first hinge link to said wall-related part, a second shaft for pivotally connecting said first hinge link to said door-related part, means for pivotally connecting said second hinge link to said wall-related part and to said door-related part, said first hinge link being closer to said attachment means than said second hinge link, a single-arm lever forming a compression spring and having a stationary end journalled in said wall-related part and also having a free end, a cam body having a cam face engaged by said free end of said compression spring, a third shaft for pivotally supporting said cam body in said wall-related part, and guide means in said cam body for displaceably guiding said first hinge link between said first and second shafts, said third shaft being in all positions of the hinge at a greater distance from said cam face than said first shaft.

2. A hinge according to claim 1, wherein said cam body extends with clearance substantially over the entire width of said first hinge link, and wherein said guide means is a slot-like opening for passage therethrough of said first hinge link.

3. A hinge according to claim 2, wherein said first hinge link has a pivot eye, said cam body has side faces which extend laterally slightly beyond said pivot eye, and has a cavity enclosed by side walls laterally covering end faces of said pivot eye, arcuate slots being provided in said side walls for the passage therethrough of said first shaft.

4. A hinge according to claim 1, wherein said cam body is composed of two mirror-image-symmetrical cam body halves placed over said first hinge link.

5. A hinge according to claim 4, wherein said cam body halves are joined to each other after placement over said first hinge link.

6. A hinge according to claim 1, wherein said cam body consists of plastic.

* * * * *